US006359393B1

(12) United States Patent
Brown

(10) Patent No.: US 6,359,393 B1
(45) Date of Patent: Mar. 19, 2002

(54) DIMMER FOR A GAS DISCHARGE LAMP EMPLOYING FREQUENCY SHIFTING

(75) Inventor: Craig Brown, Sterling, VA (US)

(73) Assignee: Logic Laboratories, Inc, Leesburg, VA (US)

( * ) Notice: Subject to any disclaimer, the term of this patent is extended or adjusted under 35 U.S.C. 154(b) by 0 days.

(21) Appl. No.: 09/049,137

(22) Filed: Mar. 27, 1998

Related U.S. Application Data

(62) Division of application No. 08/656,684, filed on May 31, 1996.

(51) Int. Cl.[7] ..... H05B 37/02

(52) U.S. Cl. ..... 315/307; 315/209 R; 315/DIG. 7; 315/224; 315/DIG. 4; 315/308

(58) Field of Search ..... 315/224, 307, 315/209 R, DIG. 7, 243, DIG. 5, DIG. 4, 308; 363/97, 109, 131

(56) References Cited

U.S. PATENT DOCUMENTS 5,075,602 A * 12/1991 Overgoor et al. ..... 315/307
5,198,726 A * 3/1993 Van Meurs et al. ..... 315/224

* cited by examiner

*Primary Examiner*—Michael B Shingleton
(74) *Attorney, Agent, or Firm*—Sofer & Haroun, LLP

(57) ABSTRACT

An improved dynamic range dimmer for gas discharge lamps is provided in which the frequency is shifted during the startup of the lamp, and the frequency is shifted and the duty cycle is varied to dim the light emitted by the lamp. When dimming is desired the frequency is shifted to increase the voltage available to the lamp, which then has its power reduced by controlling its duty cycle. Such an arrangement provides a greater range of light intensity variation. If the lamp is turned off while set to a dimmed level, then the frequency is automatically restored to the resonant value used when starting the lamp, to assure breakdown of the plasma in the lamp for proper ignition.

6 Claims, 3 Drawing Sheets

VARIATION 'A', TUBE CURRENT CONTROLS FREQUENCY SHIFT

DIMMER FOR A GAS DISCHARGE LAMP EMPLOYING FREQUENCY SHIFTING

This application is a division of application Ser. No. 08/656,684 filed May 31, 1996.

BACKGROUND OF THE INVENTION

1. Field of the Invention

The present invention pertains to an improved dynamic range dimmer for a gas discharge lamp. In particular, the present invention relates to a dimmer, for a gas discharge tube, which provides sufficient voltage to sustain gas discharge tube arc during manual dimming and accommodates aging of the gas discharge tube.

2. Description of the Prior Art

The impedance characteristics of gas discharge lamps are both non-linear and a negative resistance, such that current flowing through the lamp is not directly proportional to the voltage supplied to the lamp. Until a minimum voltage is reached, the current through the gas discharge lamp is zero. The lamp conducts only after the minimum voltage is achieved. Ballasts are connected in series with the gas discharge lamps to limit the current, which would otherwise increase rapidly and unchecked.

If a load in an alternating current (AC) circuit is equivalent to a pure resistance then the circuit would have a power factor of one. Such a power factor of one is preferred and means that the voltage and current are sinusoidal and in phase with one another.

Dimming of gas discharge lamps is difficult due to the non-linear characteristics of gas discharge lamps. It is highly desirable to vary the light intensity of gas discharge lamps over a large range. A range of least 10:1 is required in most situations, with a range of 20:1 being preferred. One reason for having a large range is that the eye is a non-linear device, especially at high light levels, and a change of 30% is barely perceptible.

Another reason a large range is desired is to save energy. It is preferable to run the gas discharge lamps at very low levels when a room is unoccupied. Most existing designs barely reach the 10:1 ratio, and very few of those exceed it. Yet another problem with existing gas discharge lamp configurations is if they have a dimming capability, when they are in a dimmed condition and the power is interrupted, the gas discharge lamp cannot be restarted, or is very difficult to restart until it is restored to the undimmed state.

Various methods of dimming have been developed, all of which limit power to the gas discharge lamp. These approaches can be divided into three types. First, one can control the amplitude of the energy fed into the lamp via its external circuitry. This can be achieved by voltage or current limiting at either AC or DC inputs. If the ballast is electronic and has an inverter, the AC or DC levels can be limited. Second, one can control the duty cycle or "on time" of the AC; again either internally or at the input. There are various methods to control the duty cycle, for example, pulse width modulation phase control, etc. Third, in electronic ballasts the frequency can be varied.

To ensure proper gas discharge tube startup, the frequency of the driving oscillator must match the resonant frequency of the series resonant output circuit. At resonance the voltage developed across the output circuit reaches peak value. The amount the peak value is above the driver input voltage is dependent upon the quality factor or Q, of the output circuit. The peak voltage must be sufficient to initiate the arc in the gas discharge tube. Once the tube arc has started, it is no longer necessary to develop the peak voltage. Furthermore, maintaining operation of the resonant frequency of the output circuit will cause a loss of power in the series resonant output circuit.

In view of the foregoing, it is an object of the present invention to provide a dimmer for gas discharge lamps which has a large range of dimming.

Another object of the present invention is to provide a dimmer for gas discharge lamps in which the gas discharge lamp will resume emitting light at a dimmed level, after the light is dimmed and the power is subsequently interrupted.

A further object of the present invention is to provide a dimmer for gas discharge lamps which frequency shifts in the start mode and employs frequency shifting and variation of the duty cycle to accomplish dimming.

SUMMARY OF THE INVENTION

The foregoing and other objects are achieved by the present invention in which the frequency is shifted during the startup of the lamp, and the frequency is shifted and the duty cycle is varied to dim the light emitted by the lamp. When dimming is desired the frequency is shifted to increase the voltage available to the lamp, which then has its power reduced by controlling its duty cycle. Such an arrangement provides a greater range of light intensity variation. If the lamp is turned off while set to a dimmed level, then the frequency is automatically restored to the resonant value used when starting the lamp, to assure breakdown of the plasma in the lamp for proper ignition.

A potential problem in shifting the driving frequency after the lamp startup is that lamp dimming, or the operation of aged lamps may become impossible. Such failure is caused by the lowering of the peak voltage developed across the output circuit by not operating on the peak of the Q curve (resonance). Older gas discharge tubes have a higher running voltage requirement. Dimming, accomplished by lowering of the input voltage to the tube driver, increases the requirement of the series resonant output circuit to operate closer to resonance and develop a higher output voltage relative to the driver input voltage.

Both of the foregoing problems can be solved by making the frequency shift proportional to the running current of the tube. There must also be upper and lower limits in the frequency swing. The upper limit is set to the resonance of the output circuit, and lower limit is set to cause the running current of the lamp tube to reach its desired value. As the running current of the lamp tube lowers to a threshold (due to aging or manual dimming), the operating frequency will start to move closer to the resonance of the output circuit. IN this manner a sufficient voltage to sustain the lamp tube arc, during tube aging and manual dimming, is assured.

The present invention starts the tube arc at the resonant frequency of the driver output circuit. After a time delay which is proportional to the tube current being a starting threshold level, the frequency is shifted to a lower level until the desired lamp tube running current is reached. If the lamp tube running current is lowered below a second threshold, the operating frequency of the driver will start to rise toward resonance of the output circuit to ensure that the tube arc will be maintained.

The dimming level can then be set using one of the alternative methods described above. In effect, the present invention combines prior methods. By shifting back toward resonance, the voltage is adjusted to permit an alternative power limitation method, to reduce the light output of the lamp over a wider range, without the arc discharge. An additional benefit is that the present invention automatically shifts the frequency to the resonant value when starting a lamp that has been dimmed, thereby making it easier to an initiate the arc.

As an alternative, the frequency can be forced to resonance to allow dimming when the voltage input is decreased. Dimming is controlled by the input voltage. During a full voltage start (maximum light output), the driver starts the tube on resonance, or above resonance in order to light the filaments for rapid start operation. After a brief delay, on the order of a few seconds, the operation frequency shifts lower to take the output circuit off resonance and thereby minimize wasted energy in the output circuit.

As the input voltage is lowered to start a dimming operation, the output circuit must move back towards resonant operation to bridge the increasing gap between the decreasing input voltage and the increasing tube voltage requirements as the tube current decreases. Without such a frequency shift, the tube would extinguish. A restart operation of less than full illumination causes the circuit not to shift off resonance to thereby maintain the dimmed tube arc. The main reason for the frequency shift off of resonance is to increase efficiency and minimize heat dissipation in the output circuit.

BRIEF DESCRIPTION OF THE DRAWINGS

These and other attributes of the present invention will be described with respect to the following drawings in which.

DETAILED DESCRIPTION OF THE INVENTION

Figure 1:
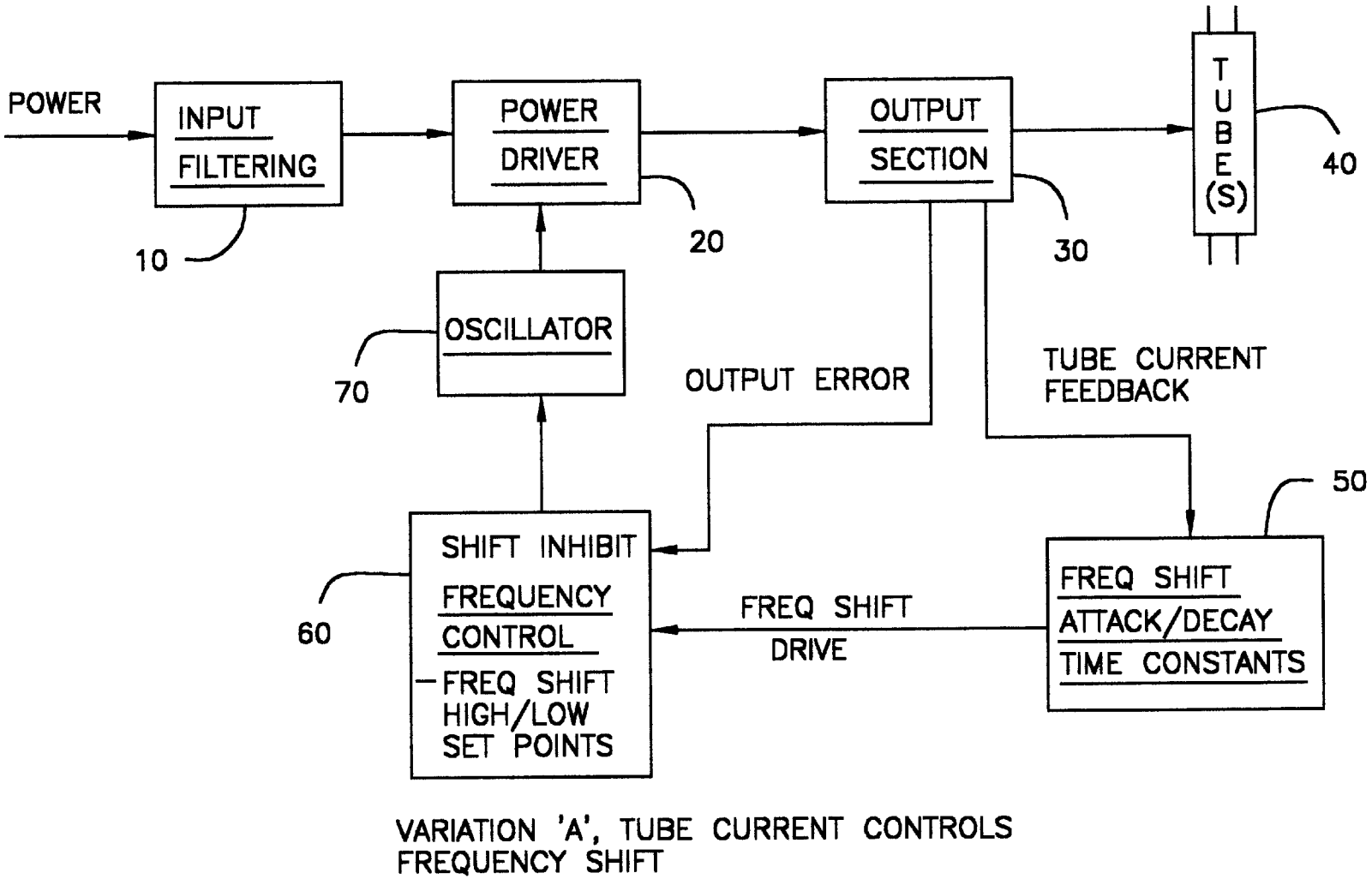
FIG. 1 is a block diagram of a first embodiment of the present invention.

A first embodiment of the present invention is shown in FIG. 1 in which power is received by an input filter 10, which may include a fuse, a varistor, and an RF inductor. Filtering is performed to meet FCC and FRI requirements. The filtered power is fed to a power driver 20. The power driver 20 may have a half-bridge FET driver and FET switches or a full-bridge configuration.

The output of the power driver 20 is sent to an output section 30. A series resonant circuit, a current limiting inductor and a current sense takeoff are part of the output section 30. Lamp tubes 40 receive the output of the output section 30.

A frequency shift attack/decay time constant generator 50 receives a tube current feedback signal from the output section 30. Similarly, a frequency control circuit 60 receives an output error signal from the output section 30. If the tube(s) 40 is not illuminated, a signal is sent to produce a switch back to resonance to allow a new tube start. Another error is the production of over-current. By compensating for such error, the driver 20 is preserved. The frequency shift attack/decay time constant generator 50 produces a frequency shift drive signal based on the tube current feedback signal from the output section 30, which is transmitted to the frequency control circuit 60. The frequency control circuit 60 has high/low set points to guarantee that the total range of operating conditions of the circuit are within acceptable ranges.

The frequency control circuit 60 sends a signal to oscillator 70 which in turn sends a signal to power driver 20. The oscillator 70 allows frequency control input and duty cycle input. In this manner, the frequency control circuit 60 drives the FET driver in the power driver 20, continuously between two frequencies. The high frequency is set at or near resonance of the series tuned resonant circuit in the output section 30. The low frequency is a fraction of the high frequency.

The frequency shift attack/decay time constant generator 50 produces a fast time constant when shifting from low to high frequency so the tubes 40 will not extinguish. A slower time constant (approximately 1/1000 of the fast time constant) is produced when shifting from high to low frequency in order to produce a shaft which is visually pleasing to occupants of the room.

Figure 2:
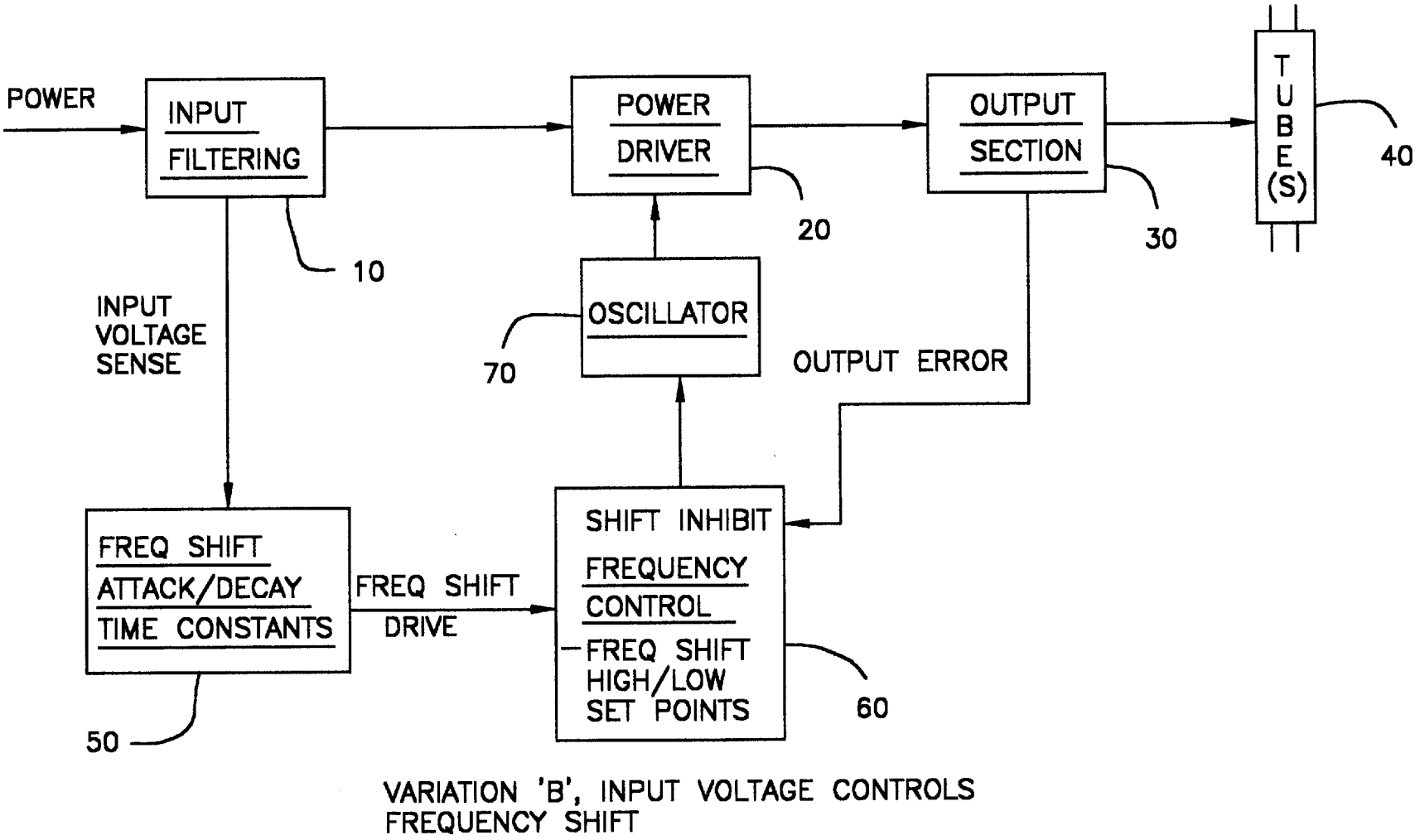
FIG. 2 is a block diagram of a second embodiment of the present invention.

In the second embodiment shown in FIG. 2, similar elements bear the same reference numbers as the first embodiment of FIG. 1. As was the case with the first embodiment, the input filter 10 receives the input power and send the filtered power to the power driver 20. The output of the power driver 20 is fed to the output section 30, which in turn controls the tubes 40. The output section 30 also sends an output error signal to the frequency control circuit 60. The frequency control circuit 60 sends a signal to the oscillator 70, which sends a control signal to the power driver 20.

The major difference between the first and second embodiments is the utilization of the frequency shift attack/decay time constant generator 50, which in the second embodiment receives an input voltage sensing signal from the input filter 10 and generates a frequency shift drive signal, which is sent to the frequency control circuit 60. Thus, the frequency shift attack/decay time constant generator 50 receives different inputs in the two embodiments. In the first embodiment of FIG. 1 the tube current controls the frequency shift, while in the second embodiment shown in FIG. 2, the input voltage controls the frequency shift.

Figure 3:
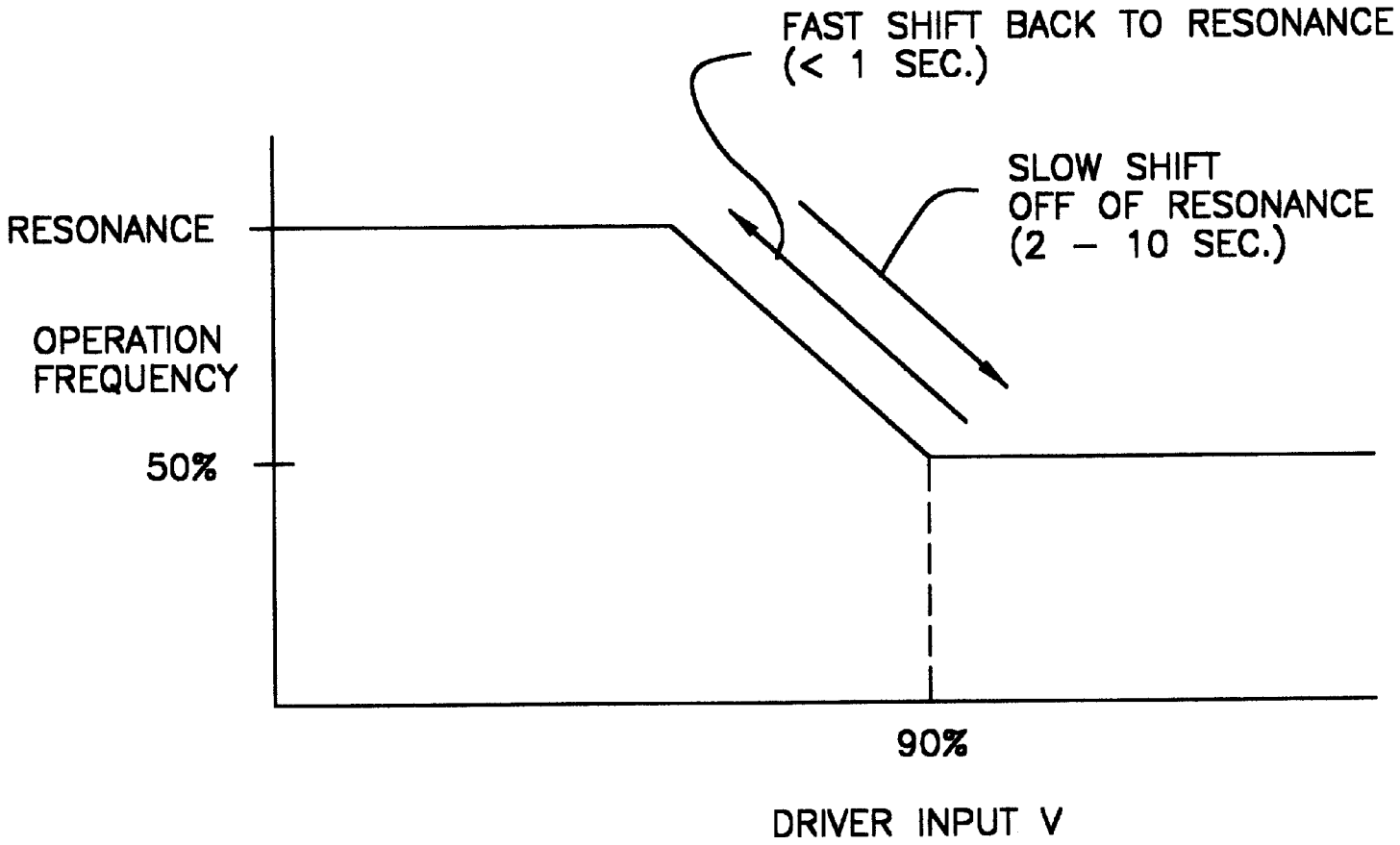
FIG. 3 is a graph of the relationship between the resonance and the driver input voltage.

FIG. 3 shows the relationship between resonance and the input voltage cf the present invention. From FIG. 3, it can be seen that if the circuit is in resonance to begin with, as the driver input increases the operation frequency decreases slowly, on the order of 2–10 seconds, until it is approximately 50% of resonance at 90% of the driver input. The operation frequency remains at approximately 50% from 90–100% of the driver input. In the reverse, as the driver input decreases from 90% the operation frequency quickly shifts back to resonance, on the order of less than one second.

Having described several embodiments of the improved dynamic range dimmer for gas discharge lamps in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A dimmer for a gas discharge lamp comprising:

a frequency shift time constant generator;

a frequency control circuit for shifting frequency during start-up of said gas discharge lamp in response to time constants generated by said frequency shift time constant generator, wherein said frequency is shifted and a duty cycle of said gas discharge lamp is varied to dim light emitted by said gas discharge lamp;

wherein, when dimming of said light from said gas discharge lamp is desired, said frequency control circuit shifts said frequency to increase voltage available to said gas discharge lamp, so that power received by said gas discharge lamp is reduced by controlling said duty cycle;

and wherein said frequency is automatically restored to a resonant value when said gas discharge lamp is turned off while set to a dimmed level.

2. The dimmer according to claim 1, wherein said time constants generated by said frequency shift time constant generator correspond to a current of said discharge tube.

3. The dimmer according to claim 1, wherein said time constants generated by said frequency shift time constant generator correspond to an input voltage applied to said discharge tube.

4. A dimmer for a gas discharge lamp comprising:

a frequency shift time constant generator;

a frequency control circuit for shifting frequency during start-up of said gas discharge lamp in response to time constants generated by said frequency shift time constant generator, wherein said frequency is shifted and a duty cycle of said gas discharge lamp is varied to dim light emitted by said gas discharge lamp;

wherein, when dimming of said light from said gas discharge lamp is desired, said frequency control circuit shifts said frequency to increase voltage available to said gas discharge lamp, so that power received by said gas discharge lamp is reduced by controlling said duty cycle;

and wherein said gas discharge lamp will resume emitting light at a dimmed level when power to said lamp is interrupted while said lamp is operating at a dimmed level.

5. The dimmer according to claim 4, wherein said time constants generated by said frequency shift time constant generator correspond to a current of said discharge tube.

6. The dimmer according to claim 4, wherein said time constants generated by said frequency shift time constant generator correspond to an input voltage applied to said discharge tube.

* * * * *